US006283401B1

(12) United States Patent
Lieber et al.

(10) Patent No.: US 6,283,401 B1
(45) Date of Patent: Sep. 4, 2001

(54) METHOD AND APPARATUS FOR WINDING A CONTINUOUSLY ADVANCING YARN

(75) Inventors: Reinhard Lieber, Sprockhövel; Martina Fabricius, Remscheid, both of (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/570,638

(22) Filed: May 15, 2000

(30) Foreign Application Priority Data

May 14, 1999 (DE) ..... 199 22 394

(51) Int. Cl.[7] ..... B65H 54/38

(52) U.S. Cl. ..... 242/477.2; 242/477.3; 242/477.6

(58) Field of Search ..... 242/477.1, 477.2, 242/477.3, 477.5, 477.6

(56) References Cited

U.S. PATENT DOCUMENTS 4,204,653 * 5/1980 Nose et al. ..... 242/477.1 X
4,325,517 * 4/1982 Schippers et al. ..... 242/477.2
4,498,637 * 2/1985 Yamamoto et al. ..... 242/477.2
4,555,069 * 11/1985 Maeda et al. ..... 242/477.2
4,659,027 * 4/1987 Schippers et al. ..... 242/477.5
4,913,363 4/1990 Lenz .
5,112,001 * 5/1992 Yamamoto et al. ..... 242/477.2
6,065,712 * 5/2000 Mayer et al. ..... 242/477.2
6,196,491 * 3/2001 Kross et al. ..... 242/477.3

FOREIGN PATENT DOCUMENTS 0 235 557 B1 3/1990 (EP) .

* cited by examiner

*Primary Examiner*—Michael R. Mansen
(74) *Attorney, Agent, or Firm*—Alston & Bird LLP

(57) ABSTRACT

A method and apparatus for winding a continuously advancing yarn, wherein the yarn is wound on a driven tube to a cross-wound package, with the yarn being reciprocated by a traversing yarn guide within a traverse stroke. The length of the traverse stroke is periodically changed, each time with a modified stroke cycle, with the yarn being deposited at the beginning of the modified stroke cycle in a starting reversal point on the outer edge of the cross-wound package. To prevent the yarn from being deposited on the circumference of the package at the same point after completion of the modified stroke cycle, the speed and/or the traverse stroke of the traversing yarn guide are controlled such that after completing the modified stroke cycle, the yarn is deposited at an end reversal point on the outer edge of the cross-wound package which is offset from the starting reversal point at the beginning of the modified stroke cycle.

15 Claims, 4 Drawing Sheets

METHOD AND APPARATUS FOR WINDING A CONTINUOUSLY ADVANCING YARN

BACKGROUND OF THE INVENTION

The present invention relates to a method and apparatus for winding a continuously advancing yarn to a package, and of the general type disclosed in EP 0 235 557 and corresponding U.S. Pat. No. 4,913,363.

When winding a yarn to a cross-wound package, the yarn is deposited at a crossing angle on the package surface within the package width at a substantially constant circumferential speed of the package. To this end, the yarn is reciprocated by a traversing yarn guide within a traverse stroke, before it contacts the package surface. To obtain a uniform mass distribution of the yarn, in particular in the edge regions of the package, it is known to shorten and lengthen the traverse stroke cyclically during the winding. This shortening and lengthening of the traverse stroke is named a so-called stroke modification. The stroke modification prevents a high edge buildup (saddle formation) of the packages.

In the method known from the above cited prior patents, the stroke modification occurs in predetermined modified stroke cycles. A modified stroke cycle is defined by the period of time, which is required for reaching again the length of the traverse stroke that has been adjusted before the stroke modification. Thus, a modified stroke cycle is formed by a plurality of modified strokes, which define one reciprocal movement of the traversing yarn guide at a modified length of the traverse stroke length. Thus, when passing through a modified stroke cycle, the yarn is deposited on the package surface in many modified strokes. The beginning of the modified stroke cycle may thus be removed from the end of the modified stroke cycle by a plurality of yarn layers. In this connection, there exists the problem that the yarns deposited at the outer edge of the package, i.e. at a maximum traverse stroke, are deposited before and after the modified stroke cycle in the same place on the circumference of the package, which leads to undesired double layers.

It is therefore an object of the invention to provide a method of the initially described kind as well as an apparatus for carrying out the method, which makes it possible to wind a cross-wound package with substantially evenly distributed yarn reversal points in the end regions of the cross-wound package.

SUMMARY OF THE INVENTION

The above and other objects and advantages of the present invention are achieved by the provision of a method and apparatus wherein the modified stroke cycle proceeds such that before and after the modified stroke cycle, the yarn reversal points are arranged offset on the circumference of the package. To this end, the speed of the traversing yarn guide or the traverse stroke of the traversing yarn guide is controlled in such a manner that after completing the modified stroke cycle, the yarn is deposited in a reversal point on the outer edge of the cross-wound package (end point). On the circumference of the package, this end reversal point is offset relative to the starting reversal point. The starting reversal point is the yarn reversal point at the edge of the package before the start of the modified stroke cycle. The special advantage of the invention lies in that the front faces of the packages exhibit a very straight-line configuration. Beadlike configurations as are caused by yarn layers overlying one another, are totally prevented. A uniform edge buildup of the package is produced.

In a particularly advantageous further development of the invention, the yarn reversal points are determined or calculated with respect to their position. To this end, one determines the instantaneous actual position of the starting point at the beginning of the modified stroke cycle. Proceeding from the instantaneous values, the complete modified stroke cycle is calculated with reference to a predetermined time for the modified stroke cycle as well as with regard to the actual position of the starting point, and a desired position of the end point is determined. By a comparison between the actual position of the starting point and the calculated desired position of the end point, it is possible to generate corresponding control signals.

In this connection, it will be especially advantageous, when the traversing speed is varied in the case that the actual position of the starting point coincides with the desired position of the end point on the circumference of the package, so that at the end of the modified stroke cycle, the yarn is deposited in an actual position of the end point that differs from the desired position. The variation of the traversing speed may occur such that, for example, a minimum distance is ensured between the starting point and the end point.

It will likewise be advantageous to modify the traverse stroke, when the actual position of the starting point and desired position of the end point coincide on the circumference of the package. The change of the traverse stroke will occur preferably by shortening or lengthening the modified stroke cycle. However, it is also possible to vary the maximum length or the minimum length of the traverse stroke for determining a modified stroke cycle.

Both the change of the traverse stroke and the variation of the traverse speed may be performed parallel. In all cases, the duration of the modified stroke cycle is changed. In this instance, the changes may shorten or lengthen the time of the modified stroke cycle.

To determine the actual position of the starting reversal point, it is proposed to determine the instantaneous angular position of the package and the instantaneous diameter of the package. This defines the starting point of the yarn reversal at the beginning of the modified stroke cycle. The determination of the diameter of the package has in this instance the special advantage that the diameter increase can be taken into account in the determination of the desired position of the end point. As the package diameter increases, and the time of the modified stroke cycle remains constant, a shorter distance is covered on the circumference of the package between the starting points and the end points.

In a particularly advantageous variant of the method, a control device performs the determination and adjustment of the yarn reversal points, as well as the control of the traversing yarn guide. The control device connects to the drive of the traversing yarn guide. The drive influences the traversing motion and traverse stroke of the traversing yarn guide.

To obtain an as precise package buildup as possible, the actual diameter of the package and the angular position may be continuously determined, so that the drive is controlled by the control device as a function of the comparison between the position of the starting reversal point and the position of the end reversal point.

The method of the present invention is independent of the type of wind. The types of wind include random wind, precision wind, or stepped precision wind. In the case of the random wind, the mean value of the traversing speed remains substantially constant during the winding cycle. In this instance, the winding ratio (spindle speed/traversing speed) will constantly change during the winding cycle. In the case of a precision wind, the winding ratio is kept constant. In the case of a stepped precision wind, however, the winding ratio is varied in steps by a predetermined program.

Likewise, it is especially advantageous to combine the method of the present invention with the known ribbon breaking methods. With that, it is possible to produce cross-wound packages with a large diameter and great package density, which ensure a troublefree overhead unwinding of the yarn at high withdrawal speeds of 1,000 m/min and greater.

The method of the present invention may be used both for producing cylindrical cross-wound packages with substantially rectangular front. faces, and for winding biconical packages with oblique front faces.

The apparatus of the present invention for carrying out the method distinguishes itself by its great flexibility in the production of packages. With the use of the apparatus, it is easy to vary the modified stroke cycles individually as a function of the calculated yarn layers. When the traverse stroke and the traversing speed are predetermined, the control device proceeds each time from an instantaneous actual diameter of the package. To this end, the control device connects to at least one sensor means for determining the speed and the angular position of the package. A data storage of the control device stores at least one modified stroke cycle and the winding speed. To determine the reversal points of the yarn on the edge of the package before and after the modified stroke cycle, the control device comprises a computer unit. An activation of the drive of the traversing yarn guide occurs as a function of the adjustment between the actual position of the starting point and the desired position of the end point. This ensures that the yarn is not deposited on the package in double layers.

The flexibility of the apparatus is still increased by the especially advantageous further development wherein the traversing yarn guide is driven by means of an electric motor, in particular a stepping motor, and wherein each position of the traversing yarn guide corresponds to a rotor position of the motor. With that, it is possible to couple the traversing speed with the respective change in the length of the traverse stroke. A shortening of the traverse stroke can thus occur at a constant traversing speed or at a constant amount of yarn that is deposited per unit time.

The rotor position of the motor is advantageously determined by an angle sensor, and supplied by the angle sensor to the control device. This feedback permits controlling the traversing yarn guide with a high precision, so that it is ensured even in the case of very short modified stroke cycles, that no double layers of the yarn form on the package. The coupling between the traversing yarn guide and the motor may occur by a bar, belt, or tapes. In this instance, it is necessary that the connecting members enable a slipfree transmission.

In a particularly advantageous further development of the invention, the sensor means is realized by a pulse generator. The pulse thus signals one rotation of the tube as well as a zero position of the tube. To this end, for example, a marking is provided, so that a pulse is signaled for each rotation. With that, it is possible to determine with advantage from a sensor signal both the diameter and the angular position of the package. However, it is also possible to form the sensor means by a speed sensor and an angle sensor. In this instance, two signals are generated, which are supplied to the control device.

The marking sensed by the pulse generator may be applied to the tube or to a centering plate mounting the tube. It will be especially advantageous, when the marking is formed by a catching groove already provided in the centering plate.

BRIEF DESCRIPTION OF THE DRAWINGS

In the following, both the method and the apparatus for carrying out the method are described in greater detail with reference to an embodiment and to the attached drawings, in which:

FIG. 2 is a schematic view of a modified stroke cycle Z;

DETAILED DESCRIPTION OF THE PREFERRED EMBODIMENTS

Figure 1:
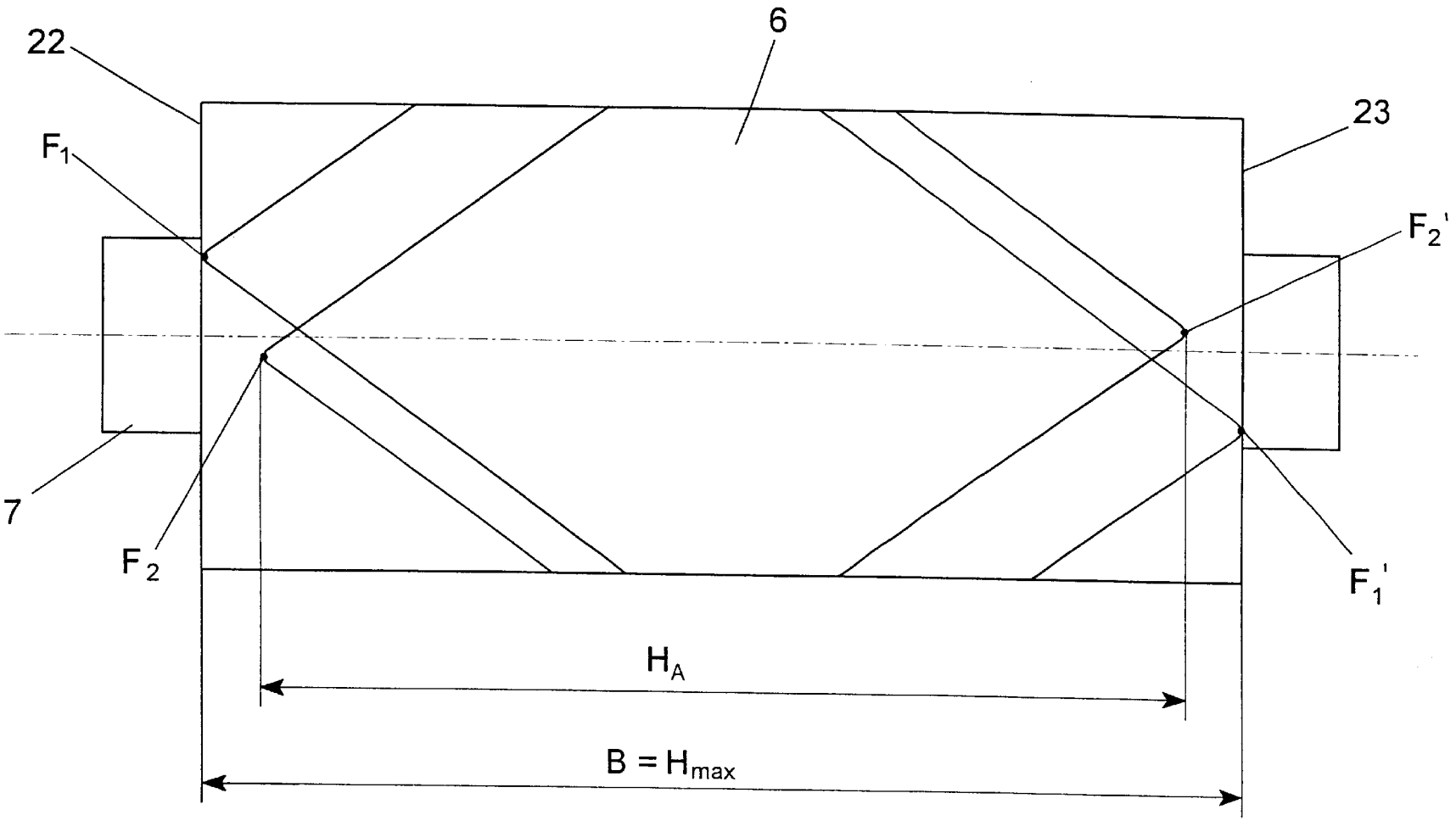
FIG. 1 is a schematic view of a cylindrical cross-wound package.

FIG. 1 is a schematic view of a cylindrical cross-wound package. The package 6 is wound on a tube 7. The package has a width B. The package width B is formed by a maximal traverse stroke $H_{max}$. The traverse stroke H is the length, over which a traversing yarn guide is reciprocated. When traversing the yarn, it is guided within the traverse stroke, before it contacts the package surface. To this end, a traversing yarn guide is driven at a predetermined traversing speed. At the ends of the package 6, shortly before its reversal, the traversing yarn guide is braked and again accelerated in the opposite direction. This yarn reversal is schematically illustrated in FIG. 1, for example, by some yarn layers on the surface of the package. The point on the package surface, which marks the change in direction of the yarn deposit due to the reversal of the traversing yarn guide, is named yarn reversal point F. As a function of the sequence of movements performed by the traversing yarn guide, the yarn reversal at the end of the package can extend over a greater length on the package surface. In this case, the yarn reversal point is to be equated with the turning point of the yarn deposit. However, it is also possible to define a yarn reversal point fictively by extending the yarn lengths deposited at the package end.

In FIG. 1, a yarn reversal point $F_1$ is plotted by way of example at the front end 22 of the package 6. The opposite front end 23 shows a yarn reversal point $F_1'$ that is produced at the same maximal traverse stroke $H_{max}$. The yarn reversal points $F_1$ ard $F_1'$ are formed on the outer edge of the package 6, with the traversing yarn guide covering the traverse stroke $H_{max}$.

During the winding cycle a so-called stroke modification is performed by cyclically shortening and lengthening the traverse stroke. To begin with, the traverse stroke $H_{max}$ is shortened by a predetermined function, constantly or in steps, to a minimal traverse stroke $H_A$, and subsequently again lengthened by a predetermined function, constantly or in steps, to the original value $H_{max}$ of the traverse stroke. FIG. 1 shows the minimal traverse stroke $H_A$. In this instance, when being reversed, the yarn is deposited in the reversal points $F_2$ on the left side of the package 6 and $F_2'$ on the right side of the package 6. The change in the traverse stroke from the traverse stroke $H_{max}$ to the traverse stroke $H_A$ and back to the traverse stroke $H_{max}$ is described a modified stroke cycle. Within a modified stroke cycle, a plurality of modified strokes are performed. In this connection, a modified stroke is a traverse stroke of a length shortened in relation to the maximum length of the traverse stroke.

In FIG. 2, a modified stroke cycle Z is schematically entered, by way of example, in a diagram. In this diagram, the traverse stroke H is plotted on the ordinate, and the package circumference U on the abscissa. In the diagram, the abscissa represents at the same time one of the front ends of the package 6. At the beginning of the modified stroke cycle Z, the yarn is deposited in the point $F_A$, when it is reversed during a modified stroke at the traverse stroke length $H_{max}$. This yarn reversal point is named starting point and compares to point $F_1$ of $F_1'$ of FIG. 1. After the modified stroke cycle Z is completed, the yarn is deposited at the end of the modified stroke cycle in a modified stroke of the length $_{Hmax}$, in a point $F_E$ on the edge of the package. This yarn reversal point is named end point, and it compares likewise to one of the points $F_1$ or $F_1'$ of FIG. 1. In the case that the distance L between the starting point $F_A$ and the end point $F_E$ equals the circumference of the package, the yarn layers are superposed in the starting point and in the end point. Such a yarn deposit is avoided by the method of the present invention, in that the modified stroke cycle Z is predetermined. To this end, the instantaneous package diameter and the instantaneous angular position of the package are determined at the beginning of the modified stroke cycle, so that the starting point $F_A$ is defined in its coordinates, since the package circumference U is proportional to $\pi \cdot D$. The angular position can be determined directly by a sensor. The diameter of the package is determined from the instantaneous rotational speed of the package, which is likewise derived from a sensor signal. Proceeding from the coordinates of the starting point $F_A$, the angular position of the yarn reversal on the package at the end of the modified stroke, i.e. the end point $F_E$ is predetermined based on a predetermined time for the modified stroke cycle as well as by taking into account the diameter increase during the modified stroke cycle. In the case that the predetermined position of the end point coincides with the actual position of the starting point on the circumference of the package, the time of the modified stroke cycle will be changed. To this end, it is possible to vary the traversing speed or the length of the stroke shortening at the beginning or in the course of the modified stroke cycle. In the case that the position of the predetermined end point does not coincide with the position of the end point on the circumference of the package, the modified stroke cycle will be performed at the predetermined traversing speeds and shortenings of the traverse stroke.

Figure 2A:
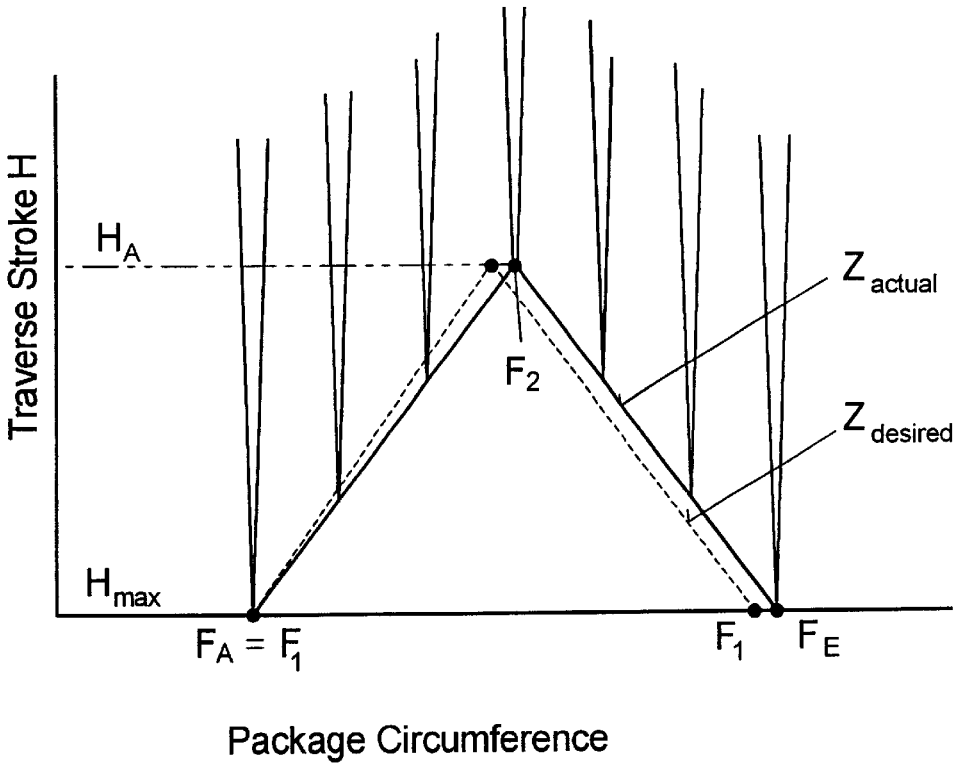
FIG. 2*a* is a view similar to FIG. 2 and showing the effect of a changed (decreased) traversing speed on the position of the end reversal point.
Figure 2B:
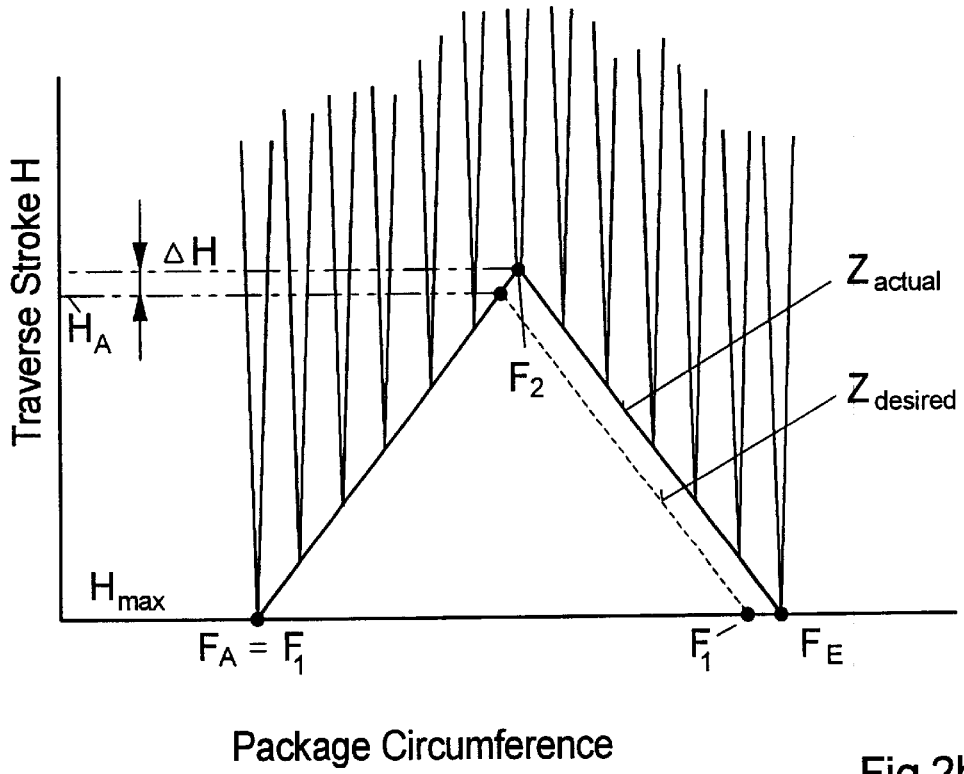
FIG. 2*b* is a view similar to FIG. 2 and showing the effect of a changed (shortened) traverse stroke length on the position of the end reversal point.

FIG. 2*a* schematically illustrates the effect of changing (decreasing) the traversing speed so as to change the modified stroke cycle, from $Z_{desired}$ to $Z_{actual}$. This in turn moves the position of the end reversal point from $F_1$ to $F_E$ FIG. 2*b* schematically illustrates the effect of changing the length (shortening) of the traverse strokes by $\Delta H$, so as to move the end reversal point from $F_1$ to $F_E$.

The method of the present invention makes it also possible to distribute evenly over the circumference of the package, the end points after each modified stroke cycle, which simultaneously define the starting point of the next modified stroke cycle in the case of a continuous stroke modification. This allows to prevent double layers in their entirety during the stroke modification, which results in particular in very flat and evenly formed front ends of the package.

Figure 3:
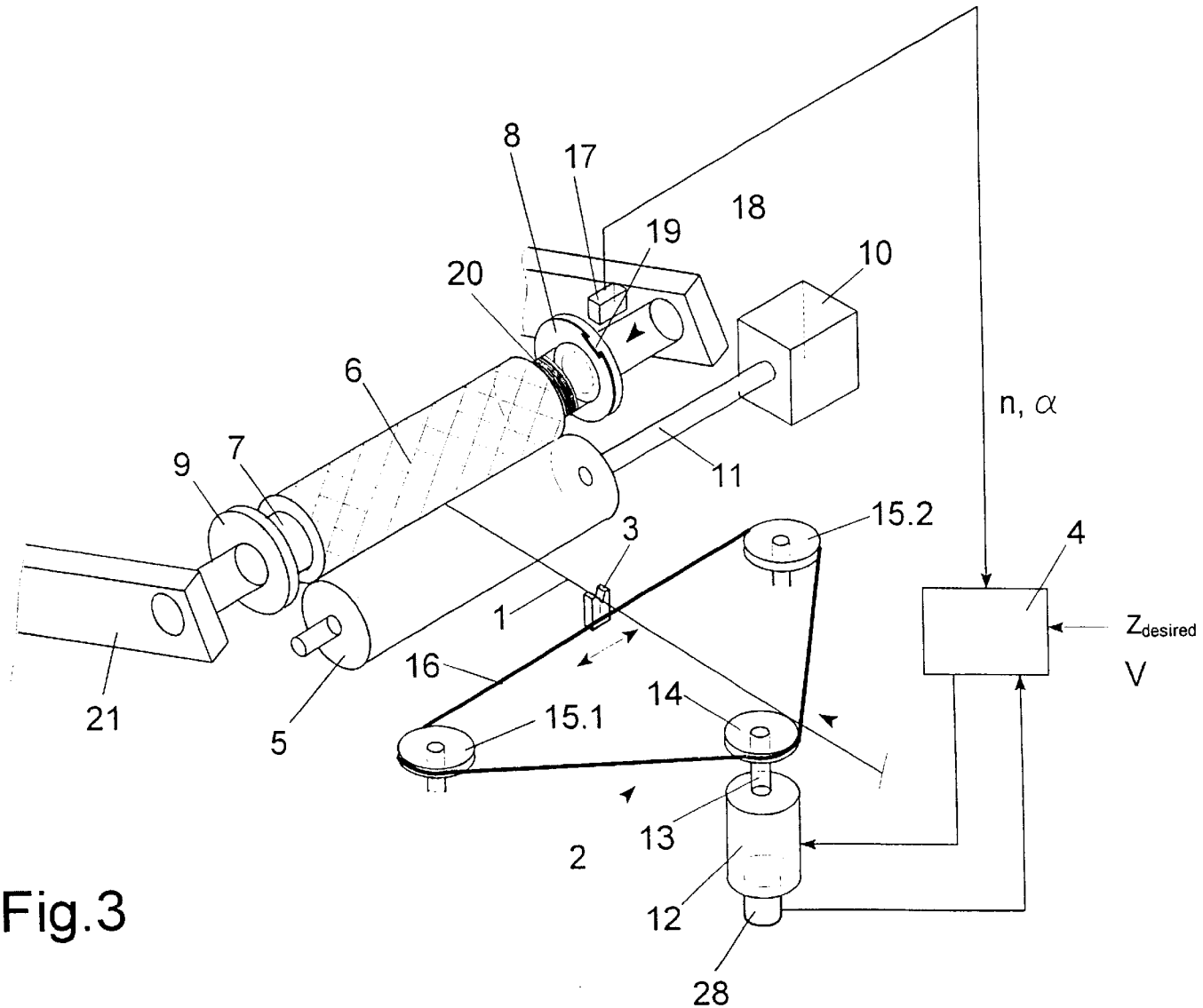

FIG. 3 illustrates an embodiment of an apparatus of the present invention, as can be used, for example, in a texturing machine. In this embodiment, the free ends of a fork-shaped package holder 21 rotatably mount two opposite centering plates 8 and 9. The package holder 21 is mounted for rotation about a pivot axle (not shown) that is arranged in a machine frame. Between the centering plates 8 and 9, a tube is clamped for receiving the package 6. A drive roll 5 lies against the circumference of the tube 7 or package 6. The drive roll 5 is mounted on a drive shaft 11. At its one end, the drive shaft 11 connects to a drive roll motor 10. The drive roll motor 10 drives the drive roll 5 at a substantially constant speed. By frictional engagement, the drive roll 5 drives the tube 7 or package 6 at a winding speed, which makes it possible to wind a yarn 1 at a substantially constant yarn speed. The winding speed remains constant during the winding cycle.

Upstream of the drive roll 5 is a yarn traversing device 2. The yarn traversing device 2 is a so-called belt-type traversing system. In this device, a traversing yarn guide 3 is mounted to an endless belt 16. The belt 16 extends between two belt pulleys 15.1 and 15.2 parallel to the tube 7. In the plane of the belt, a drive pulley 14 partially looped by the belt is arranged parallel to the belt pulleys 15.1 and 15.2. The drive pulley 14 is mounted on a drive shaft 13 of an electric motor 12. The motor 12 drives the drive pulley 14 for oscillation, so that the traversing yarn guide 3 reciprocates between the belt pulleys 15.1 and 15.2. The electric motor 12 is controllable via a controller 4. The electric motor 12, which is constructed, for example, as a stepping motor, connects to an angle sensor 28. The angle sensor 28 measures the angular rotor position of the motor. A signaling line connects the angle sensor 28 to the controller 4. The controller 4 connects to a sensor 17 arranged on the package holder 21, which measures the rotational speed of the tube 7, and supplies it as a signal to the controller 4.

In the present embodiment, the sensor 17 is a pulse generator, which senses a catch groove 19 in the centering plate 8. As a result, no additional angle sensor is needed. The catching groove 19 forms part of a catching device 18 that engages the yarn 1 at the beginning of a winding cycle and facilitates winding initial layers of the yarn on the tube 7. In this process, the pulse generator 17 releases per rotation a signal as a function of the constantly returning catching groove 19. In the controller 4, these pulses are converted for evaluating the angular position $\alpha$ and rotational speed n of the tube 7. The tube 7 is clamped between the centering plates 8 and 9 in such a manner that the centering plates 8 and 9 rotate without slip at the speed of the tube 7.

In the situation shown in FIG. 3, the yarn 1 is wound on tube 7 to the cross-wound Package 6. In so doing, the yarn 1 advances in a guide groove of the traversing yarn guide 3. The traversing device 2 reciprocates the traversing yarn guide 3 within the winding width. In this process, the movement and the traverse stroke lengths of the traversing yarn guide 3 are controlled by the motor 12, which could be, for example, a stepping motor. The increasing diameter of cross-wound package 6 is made possible by a pivotal movement of the package holder 21. To this end, the package holder 21 comprises biasing means (not shown), which generate on the one hand between the package 6 and drive roll 5 the contact pressure necessary for driving the package, and on the other hand a pivotal movement of the package holder 21.

Figure 4:
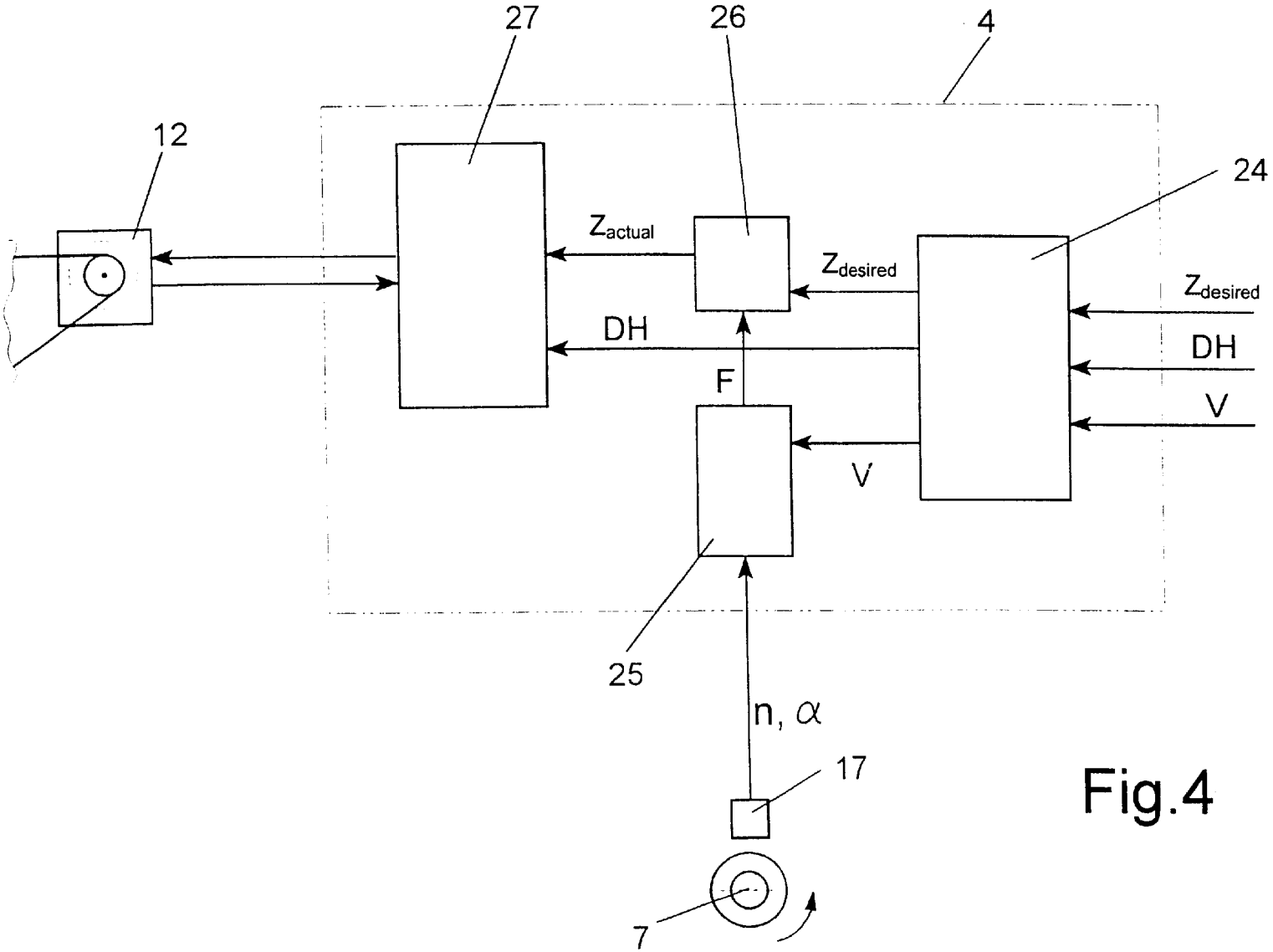

The traversing speed of the traversing yarn guide 3 as well as the length of the traverse stroke are predetermined by controller 4, which leads to the corresponding activation of motor 12. For the activation, the controller 4 receives the stroke modification function $Z_{desired}$ as well as the winding speed v. As shown in FIG. 4, the controller 4 comprises to this end a data storage 24. The data storage 24 stores further control programs besides the modified stroke cycle Z and the winding speed v. As an example, the controller 24 in FIG. 4 receives the traversing speed $D_H$ as a number of double strokes per unit time. The controller 4 includes a microprocessor. In the microprocessor, a computer unit 25 evaluates the actual rotational speed n that is continuously transmitted from the sensor 17 via a signaling line, and the angular position $\alpha$. To this end, the computer unit 25 calculates the instantaneous package diameter D from the winding speed v and the rotational speed n that are stored in the data storage 24. With that, it is possible to associate to each position of the traversing yarn guide 3 and, thus, to each contact point of the yarn 1 on the package 6, an angular position $\alpha$ of the package and a diameter D of the package 6. Since the winding speed is known, and since the control program for winding the package are likewise predetermined, it is possible to predetermine a deposit of the yarn on the package. This calculation is performed in the computer unit 26 of the controller 4. As a starting point, the computer unit 26 receives the yarn reversal point $F_A$. Proceeding from this starting point, the predetermined modified stroke cycle $Z_{desired}$ is predetermined with respect to its yarn deposits. From this calculation, one receives the end point $F_E$ of the yarn reversal after the modified stroke cycle. By comparing the position of starting point $F_A$ with the position of end point $F_E$ on the circumference of the package, it is found, whether or not the starting point $F_A$ and the end point $F_E$ coincide in their angular position on the circumference of the package, or whether there is a minimal spacing between the two yarn reversal points on the circumference. In the case that the two yarn reversal points coincide before and after the modified stroke cycle, or that a minimum distance is not kept between the yarn reversal points on the circumference, the predetermined control program for carrying out the modified stroke cycle will be changed. The change may occur by shortening or lengthening the modified strokes, or by varying the traversing speed. This determined modified stroke cycle is used for activating the motor 12. To this end, corresponding control signals of the changed stroke modification cycle $Z_{actual}$ are supplied to the motor 12. At the same time, the traversing speed and control programs respectively are input via the control unit 27. Such control programs may also be carried out as a function of the respective package diameter.

When predetermining the yarn layers, the respective diameter increase is considered. In this connection, the diameter increase represents the amount of yarn deposited on the package per unit time. With the aid of the known quantities, such as winding speed and yarn denier, as well as the length of the traverse stroke and tube diameter, it is possible to calculate the diameter increase.

To realize an as exact positioning of the traversing yarn guide 3 as possible, the angle sensor 28 connects to the controller 4 via a signaling line, which supplies to the controller 4 respectively an angular position of the rotor shaft of motor 12. This actual position of the motor is considered in the control of a desired position of the motor, so that an adjustment as well as a very precise activation of the motor are always ensured.

The apparatus of the present invention distinguishes itself by a high flexibility as well as a high precision in the winding of packages. This is accomplished in that the instantaneous package diameter and the instantaneous angular position of the package are known at any time of the winding cycle. With that, it is possible to distribute the yarn layers evenly over the circumference of the package, in particular at the front ends of the package.

That which is claimed:

1. A method of winding a continuously advancing yarn to a cross wound package, comprising the steps of reciprocating the advancing yarn by means of a traversing yarn guide within a traverse stroke within the width of the cross wound package and so as to deposit the reciprocating yarn onto a package, with the traverse stroke of the traversing yarn guide being periodically changed in length in individual modified strokes and with a plurality of modified strokes defining a modified stroke cycle, and wherein at the beginning of a modified stroke cycle the yarn is deposited at a starting reversal point on the outer edge of the cross wound package, and controlling the speed of the traversing yarn guide and/or the length of the traverse stroke of the yarn guide in such a manner that after completion of the modified stroke cycle, the yarn is deposited in an end reversal point on the outer edge of the cross wound package which is circumferentially offset from the starting reversal point.

2. The method as defined in claim 1 wherein the controlling step includes determining the actual position of the starting reversal point by means of a sensor, and determining a desired position of the end reversal point from a predetermined traversing speed and a predetermined length of the modified strokes in the modified stroke cycle.

3. The method as defined in claim 2 wherein the controlling step further includes determining whether the determined end reversal point substantially coincides with the starting reversal point, and if so, then changing the predetermined speed of the traverse stroke and the predetermined length of the modified strokes in the modified stroke cycle.

4. The method as defined in claim 2 wherein the controlling step further includes determining whether the determined end reversal point substantially coincides with the starting reversal point, and if so, then changing the predetermined speed of the traverse stroke in the modified stroke cycle.

5. The method as defined in claim 2 wherein the controlling step further includes determining whether the determined end reversal point substantially coincides with the starting reversal point, and if so, then changing the predetermined length of the modified strokes in the modified stroke cycle.

6. The method as defined in claim 2 wherein the sensor senses the instantaneous angular position of the package and the instantaneous rotational speed of the package, and wherein the controlling step further includes determining the instantaneous diameter of the package from the sensed rotational speed and the speed of the advancing yarn.

7. The method as defined in claim 6 wherein the step of determining a desired position of the end reversal point takes into account the diameter increase during the modified stroke cycle.

8. The method as defined in claim 1, wherein the traversing yarn guide is driven by a controllable drive which connects to a controller, and wherein the controlling step includes utilizing the controller to determine the actual position of the starting reversal point at the beginning of a modified stroke cycle and a desired position of the end reversal point at the end of the modified stroke cycle.

9. The method as defined in claim 8 wherein the rotational speed of the package and the angular position of the package are determined and supplied to the controller, and the controller determines the instantaneous package diameter from the rotational speed of the package and the speed of the advancing yarn, so that the controller controls a drive of the traversing yarn guide as a function of the comparison between the position of the starting reversal point and the position of the end reversal point.

10. The method as defined in claim 1, comprising the further step of varying the traverse speed of the traversing yarn guide in accordance with a predetermined control program.

11. An apparatus for winding a continuously advancing yarn to a package comprising a package holder for rotatably mounting a tube upon which the advancing yarn is wound to form a package, a yarn guide which is reciprocated by a drive within a traverse stroke (H) that is variable in length so as to form a cross wound package on the tube, a controller for controlling the traverse stroke (H), with the controller being connected to at least one sensor for determining the rotational speed and angular position of the tube, and with the controller comprising a data storage for receiving at least one modified stroke cycle and a winding speed, and a computer unit for determining the positions of a starting reversal point and an expected end reversal point of the yarn at the edge of the package before and after the modified stroke cycle respectively, and wherein the controller connects to the drive of the traversing yarn guide for controlling the traversing speed and the traverse stroke so as to avoid having the end reversal point coincide with the starting reversal point.

12. The apparatus of claim 11, wherein the drive of the traversing yarn guide is an electric motor having a rotor and which determines from the position of said rotor the traversing motion and the traverse stroke of the traversing yarn guide.

13. The apparatus of claim 12, wherein the motor comprises an angle sensor which determines the rotor position of the motor, and which connects to the controller.

14. The apparatus of claim 11, wherein the sensor comprises a pulse generator which signals a rotation of the tube by a pulse to the controller.

15. The apparatus of claim 14, wherein the pulse of the pulse generator is releasable by a marking on the tube or on a centering plate mounting the tube.

* * * * *

UNITED STATES PATENT AND TRADEMARK OFFICE

CERTIFICATE OF CORRECTION

PATENT NO. : 6,283,401 B1
DATED : September 4, 2001
INVENTOR(S) : Lieber et al.

It is certified that error appears in the above-identified patent and that said Letters Patent is hereby corrected as shown below:

Drawings,
Insert Fig. 2 as shown below:

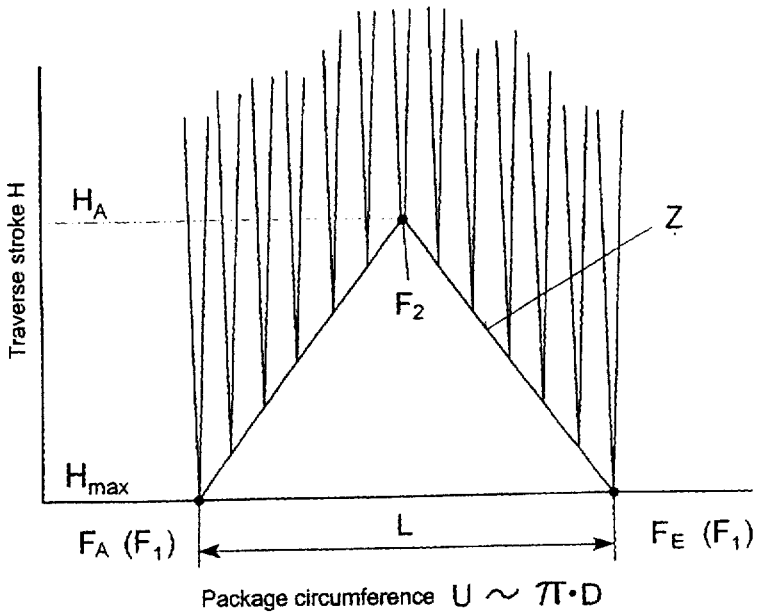

Fig.2

UNITED STATES PATENT AND TRADEMARK OFFICE

CERTIFICATE OF CORRECTION

PATENT NO. : 6,283,401 B1
DATED : September 4, 2001
INVENTOR(S) : Lieber et al.

It is certified that error appears in the above-identified patent and that said Letters Patent is hereby corrected as shown below:

Column 4,
Line 23, insert the following:
-- FIG. 3 is a schematic view of an apparatus according to the invention for carrying out the method; and
FIG. 4 is a schematic view of the control device of the apparatus of Figure 3. --.

Column 5,
Line 55, after "$F_E$" insert a period -- . --.

Signed and Sealed this

Twenty-third Day of April, 2002

*Attest:*

*Attesting Officer*

JAMES E. ROGAN
*Director of the United States Patent and Trademark Office*